US007654107B2

(12) United States Patent
Okuda et al.

(10) Patent No.: US 7,654,107 B2
(45) Date of Patent: Feb. 2, 2010

(54) LOW-TEMPERATURE STORAGE

(75) Inventors: Satoshi Okuda, Ota (JP); Yasuhide Watanabe, Osato-gun (JP); Yasushi Sakata, Tatebayashi (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 310 days.

(21) Appl. No.: 10/966,100

(22) Filed: Oct. 18, 2004

(65) Prior Publication Data

US 2005/0138956 A1 Jun. 30, 2005

(30) Foreign Application Priority Data

Oct. 21, 2003 (JP) ..... 2003-361309

(51) Int. Cl.

| | |
|---|---|
| ***F25D 11/00*** | (2006.01) |
| ***F25D 11/02*** | (2006.01) |
| ***F25D 19/00*** | (2006.01) |
| ***A47B 96/04*** | (2006.01) |

(52) U.S. Cl. ..... 62/441; 312/401; 312/405; 62/440; 62/298

(58) Field of Classification Search ..... 62/440, 62/441, 298; 312/405, 400, 401; 49/396
See application file for complete search history.

(56) References Cited

U.S. PATENT DOCUMENTS

| | | | | |
|---|---|---|---|---|
| 3,400,492 | A * | 9/1968 | Bell et al. | 49/504 |
| 4,516,335 | A * | 5/1985 | Aoki et al. | 34/608 |
| 4,861,099 | A * | 8/1989 | Sasamura et al. | 296/202 |
| 6,006,817 | A * | 12/1999 | Stone et al. | 160/201 |
| 6,401,478 | B2 * | 6/2002 | Dasher et al. | 62/344 |
| 6,655,760 | B1 * | 12/2003 | Sakata et al. | 312/116 |
| 6,817,804 | B2 * | 11/2004 | Le Gallo et al. | 403/408.1 |
| 2001/0022244 | A1 * | 9/2001 | Takada | 180/65.2 |
| 2002/0093276 | A1 * | 7/2002 | Kawakami | 312/405 |

FOREIGN PATENT DOCUMENTS

| | | |
|---|---|---|
| JP | 2000-356461 | 12/2000 |
| JP | 2001-183052 | 7/2001 |

OTHER PUBLICATIONS

Industrial Property Digital Library, Computer Generated, English Translation of JP 2000-356461, Detailed Description and Description of Drawings, http://www19.ipdl.ncipi.go.jp/PA1/cgi-bin/PA1INDEX (printed on Nov. 8, 2006).*

* cited by examiner

*Primary Examiner*—William C Doerrler
(74) *Attorney, Agent, or Firm*—Edwards Angell Palmer & Dodge LLP

(57) ABSTRACT

A low-temperature storage cooled/maintained in an ultra low temperature range, in which door lowering is automatically modified by an opening/closing operation of a thermal insulating door, and a concave/convex portion which is a contact portion with respect to a door switch disposed on the door can be secured. The low-temperature storage includes a thermal insulation box main body having an opening in a front surface thereof; a thermal insulating door openably/closably attached to the thermal insulation box main body by a plurality of hinges to close the opening; and a cooling device which cools a storage chamber formed by the door and the main body, wherein a spacer having a guide surface to forcibly correct door lowering by a closing operation of the thermal insulating door is disposed on a side on which any hinge is not disposed.

6 Claims, 9 Drawing Sheets

CLOSED TIME

BEGINNING OF ABUTTING

TIME OF NON-ABUTTING

CLOSED TIME

BEGINNING OF ABUTTING

TIME OF NON-ABUTTING

LOW-TEMPERATURE STORAGE

BACKGROUND OF THE INVENTION

Field of the Invention

The present invention relates to a low-temperature storage including a storage chamber cooled/maintained in an ultra low temperature range around −80° C. by a cooling device comprising a binary refrigeration circuit which realizes a lower storage temperature by cascade connection of an evaporator in a refrigeration circuit on a high-temperature side to a condenser in a refrigeration circuit on a low-temperature side. The present invention relates particularly to an improvement of an insulating door.

Among low-temperature storages, there is a storage in which a binary refrigeration circuit is used in order to produce an ultra low temperature range of about −60° C. to −90° C. and which is constituted by cascade connection of an evaporator of a refrigeration circuit on a high-temperature side to a condenser of a refrigeration circuit on a low-temperature side. This low-temperature storage is sometimes referred to as an ultra low temperature freezer by its temperature band. Because the interior of the storage chamber is cooled/maintained in the ultra low temperature range, a temperature difference between the storage chamber and the periphery of the low-temperature storage is about 100° C. Therefore, when performances of an insulating material are enhanced, and a thickness of the material is increased for a purpose of enhancing insulating properties of a door of the low-temperature storage, a weight of the door naturally increases. Therefore, not only rigidity of the door itself but also rigidities of hinges or hinge attaching portions for supporting the door need to be enhanced. To enhance the rigidity of the door, for example, as described in Japanese Patent Application Laid-Open No. 2000-356461, a shape of the door is formed into a concave/convex structure, an opening peripheral edge portion in an insulation box main body is thickened as compared with other portions, or a door lowering preventive guide is disposed on an opening peripheral edge positioned on a shaft support side of the door. Furthermore, for enhancement of thermal insulation performances, for example, as described in Japanese Patent Application Laid-Open No. 2001-183052, there has been a refrigerator in which both an outer door and an inner door are filled with a foam insulating material.

In the refrigerator described in the latter document, any countermeasure is not taken assuming occurrence of door lowering. The refrigerator described in the former document has a purpose for positively enhancing the rigidity of the door, and has a disadvantage in that the refrigerator is incapable of exerting its effect with respect to the lowering of the door by a slight dimension. Especially a preventive guide for preventing the thermal insulating door from being lowered is disposed on a side on which the hinges are attached, that is, on a shaft supporting side of the door.

Moreover, every time the door is opened/closed, outside air enters the storage chamber, moisture of air in the storage chamber is dew-condensed/frozen on an opening peripheral edge portion which is most easily influenced by a temperature difference, and a frosting phenomenon occurs. When the door is repeatedly opened/closed over time, this frosted portion is enlarged in the opening peripheral edge portion as if it gradually grew. This enlargement becomes considerable, and sometimes results in a situation in which the door cannot be closed. Furthermore, because the door is opened by manual operation, the door is not securely closed by mistake in the manual operation, and so-called a possibility of forgetting to close the door cannot be denied. To detect when the door is forgotten to close/open, in the low-temperature storage cooled/maintained in the ultra low temperature range, usually a door switch is disposed on the side of the door which is not easily influenced by the temperature difference. In either of the above-described documents, any door switch has not been considered.

SUMMARY OF THE INVENTION

An object of the present invention is to provide a low-temperature storage cooled/maintained in an ultra low temperature range, in which door lowering is automatically modified (corrected) by an opening/closing operation of a thermal insulating door, and a concave/convex portion which is a contact portion with respect to a door switch disposed on the door can be secured.

According to the present invention, there is provided a low-temperature storage (1) comprising: a thermal insulation box main body (2) having an opening (2A) in a front surface thereof; a thermal insulating door (4) openably/closably attached to the thermal insulation box main body by a plurality of hinges to close the opening; and a cooling device which cools a storage chamber (5) formed by the door and the main body, wherein a spacer (21, 40, 50) having a guide surface (22, 42, 52) to forcibly correct door lowering by a closing operation of the thermal insulating door is disposed on a side on which any hinge is not disposed.

According to the present invention, the lower surface of the thermal insulating door is guided upwards along the guide surface (22, 42, 52) every closing operation of the thermal insulating door (4), and a lowered dimension is corrected by the guide surface (22, 42, 52) of the spacer (21, 40, 50) disposed on the side on which any hinge is not disposed. Therefore, a user can automatically and forcibly correct the door lowering of the thermal insulating door utilizing a closing force of the door at the time of a door opening/closing operation. Additionally, the spacer (21, 40, 50) is positioned on the side on which any hinge is not disposed. Therefore, even when the door lowering by a slight dimension occurs because of a change with time, deterioration over a year or the like, the door lowering can be correctly grasped, because the spacer is distant from the hinge. This can contribute to the correction of the lowered dimension of the door, and the door lowering accompanying the change with time or the deterioration over a year can be prevented.

Moreover, in the low-temperature storage (1) of the present invention, the spacer (40) is disposed on the thermal insulating door (4).

According to the present invention, because the spacer (40) is disposed on the thermal insulating door (4), any user cannot easily notice the existence of the spacer, and there is not any anxiety that a design property of the door is impaired.

Furthermore, in the low-temperature storage (1) of the present invention, the spacer (50) is disposed on the thermal insulation box main body (2).

According to the present invention, because the spacer (50) is disposed on the thermal insulation box main body (actually, a front panel (7)), the lower surface of the thermal insulating door is guided upwards along the guide surface (52) every closing operation of the thermal insulating door (4), a lowered dimension of the door is corrected, and additionally the spacer also functions as a discharge passage of dew condensation water generated on an opening peripheral edge.

Moreover, in the low-temperature storage (1) of the present invention, the spacer is constituted of a door-side spacer (35) disposed on the thermal insulating door (4), and a main-body-side spacer (21) disposed on the thermal insulation box main body (2), and especially a material of the spacer is a DURACON® resin.

According to the present invention, the spacer is constituted of the door-side spacer (35) disposed on the thermal insulating door (4), and the main-body-side spacer (21) disposed on the thermal insulation box main body (actually, front panel (7)). Therefore, even with the occurrence of the door lowering having a dimension which is smaller than that of a gap between the lower surface of the door and the opening peripheral edge of the thermal insulation box main body, the door lowering can be instantly corrected. Since both the spacers are formed of the DURACON® resin, the spacers are strong against wear or change with time because of contacting/sliding between the spacers, and durability of the spacer is enhanced.

Moreover, according to the present invention, there is provided a low-temperature storage (1) comprising: a thermal insulation box main body (2) having an opening (2A) in a front surface thereof; a thermal insulating door (4) openably/closably attached to the thermal insulation box main body by a plurality of hinges to close the opening; and a cooling device which cools a storage chamber (5) formed by the door and the main body, wherein a main-body-side spacer (21) having: a guide surface (22) to forcibly correct door lowering by a closing operation of the thermal insulating door; and a receiving portion (24) to receive a door switch (30) disposed on the lower surface of the thermal insulating door positioned on a side on which any hinge is not disposed, and formed of a resin is disposed on an opening edge of the thermal insulation box main body positioned on the side on which any hinge is not disposed.

According to the present invention, the lower surface of the thermal insulating door is guided upwards along the guide surface (22) every closing operation of the thermal insulating door (4), and the lowered dimension is corrected in the guide surface (22) by the resin-made main-body-side spacer (21) disposed on the opening edge of the thermal insulation box main body on the side on which any hinge is not disposed. Therefore, a user can automatically and forcibly correct the door lowering of the thermal insulating door utilizing a closing force of the door at the time of a door opening/closing operation. Moreover, the door switch (30) disposed on the lower surface of the thermal insulating door (4) positioned on the side on which any hinge is not disposed can be received by the receiving portion (24) of the main-body-side spacer (21), and therefore it is possible to dispose the door switch (30) as closer to an end of the door on a non-shaft-support side as possible.

Moreover, in the low-temperature storage (1) of the present invention, the door switch (30) is supported by a door-side spacer (35) disposed on the lower surface of the thermal insulating door positioned on the side on which any hinge is not disposed.

According to the present invention, the door switch (30) is supported by the door-side spacer (35) disposed on the lower surface of the thermal insulating door (4) positioned on the side on which any hinge is not disposed, therefore the door switch can be more firmly fixed/supported, and a support member can be omitted.

Furthermore, in the low-temperature storage (1) of the present invention, the main-body-side spacer (21) has a fixing hole (27) in a rear part thereof, and a supporting protrusion (26) on a front part thereof.

According to the present invention, the main-body-side spacer (21) has the fixing hole (27) in the rear part, and the supporting protrusion (26) on the front part. Therefore, when the main-body-side spacer (21) is fixed to an attaching position, the supporting protrusion (26) is allowed to abut on the back surface of an outer box in a predetermined position, and is positioned, and a fixing member (28) such as a screw is fitted into the fixing hole (27) so that the spacer may be fixed. Attaching operation efficiency can be enhanced, and the number of components can be reduced.

Additionally, in the low-temperature storage (1) of the present invention, the receiving portion (24) comprises: an abutment surface (25) having a tilt larger than that of the guide surface (22).

According to the present invention, since the receiving portion (24) of the main-body-side spacer (21) comprises the abutment surface (25) having an inclination angle larger than that of the guide surface (22), a switching operation of the door switch (30) can be performed with a smaller depth dimension.

Moreover, according to the present invention, there is provided a low-temperature storage (1) comprising: a thermal insulation box main body (2) having an opening (2A) in a front surface thereof; a thermal insulating door (4) openably/closably attached to the thermal insulation box main body by a plurality of hinges to close the opening; and a cooling device which cools a storage chamber (5) formed by the door and the main body, the storage further comprising: a main-body-side spacer (21) having a guide surface (22), disposed on an opening edge of the thermal insulation box main body positioned on a side on which any hinge is not disposed, to forcibly correct door lowering by a closing operation of the thermal insulating door (4), and a receiving portion (24) to receive a door switch (30) disposed on the lower surface of the thermal insulating door positioned on the side on which any hinge is not disposed; and a door-side spacer (35), disposed on the lower surface of the thermal insulating door positioned on the side on which any hinge is not disposed, to abut on the guide surface (22) by a closing operation of the thermal insulating door so that door lowering is forcibly corrected.

According to the present invention, the lower surface of the thermal insulating door is guided upwards along the guide surface (22) every closing operation of the thermal insulating door (4), and the lowered dimension is corrected by the guide surface (22) of the main-body-side spacer (21) disposed on the opening edge of the thermal insulation box main body, positioned on the side on which any hinge is not disposed. Therefore, the user can automatically and forcibly correct the door lowering of the thermal insulating door utilizing a closing force of the door at the time of a door opening/closing operation. Moreover, the door switch (30) disposed on the lower surface of the thermal insulating door (4) positioned on the side on which any hinge is not disposed is received by the receiving portion (24) of the main-body-side spacer (21), and therefore it is possible to dispose the door switch (30) as closer to an end of the door on a non-shaft-support side as possible. Furthermore, the door-side spacer (35) disposed on the lower surface of the thermal insulating door (4), positioned on the side on which any hinge is not disposed, abuts on the guide surface (22), and is capable of forcibly correcting the door lowering.

DETAILED DESCRIPTION OF THE PREFERRED EMBODIMENTS

Figure 1:
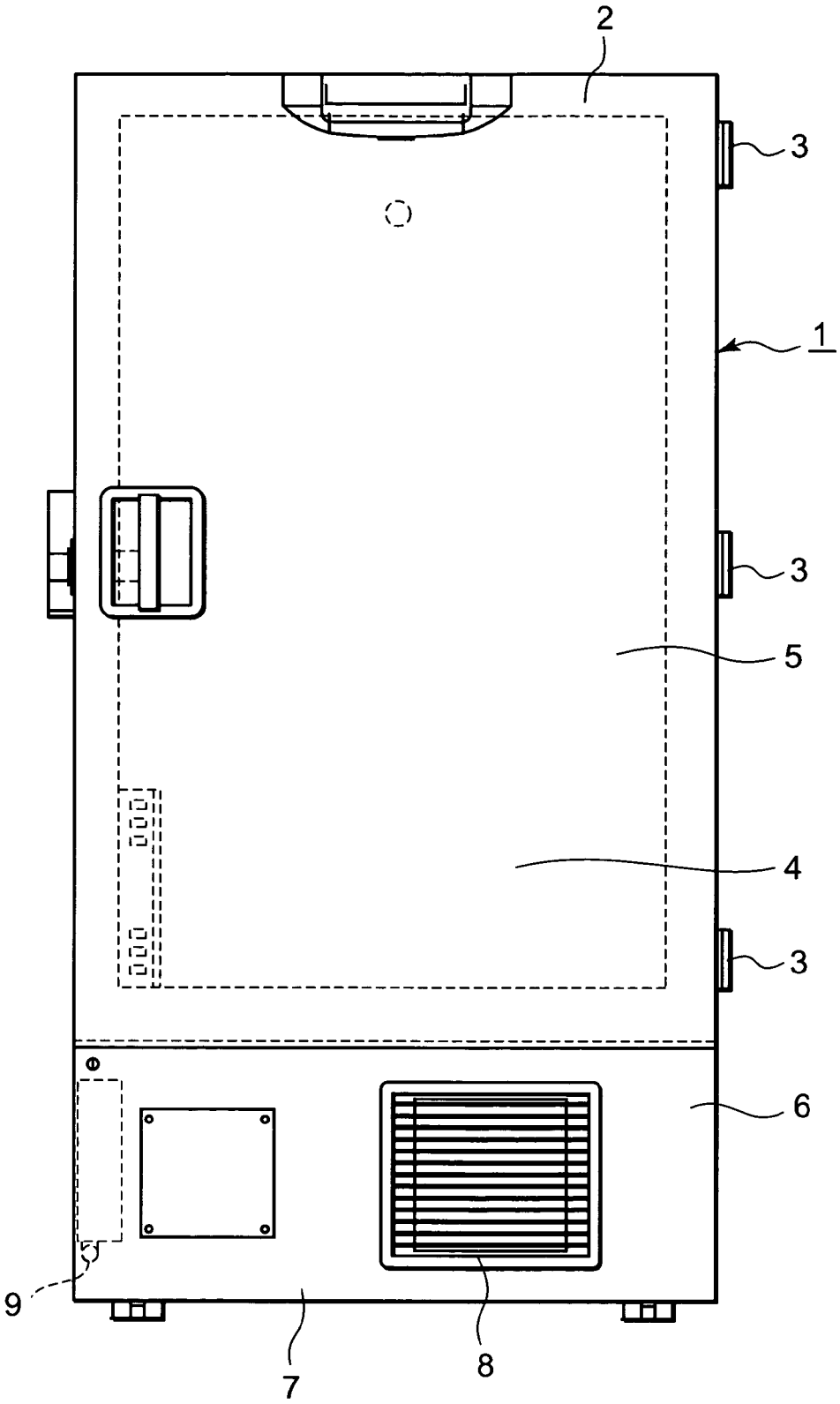
FIG. 1 is a front view of a low-temperature storage of the present invention.
Figure 2:
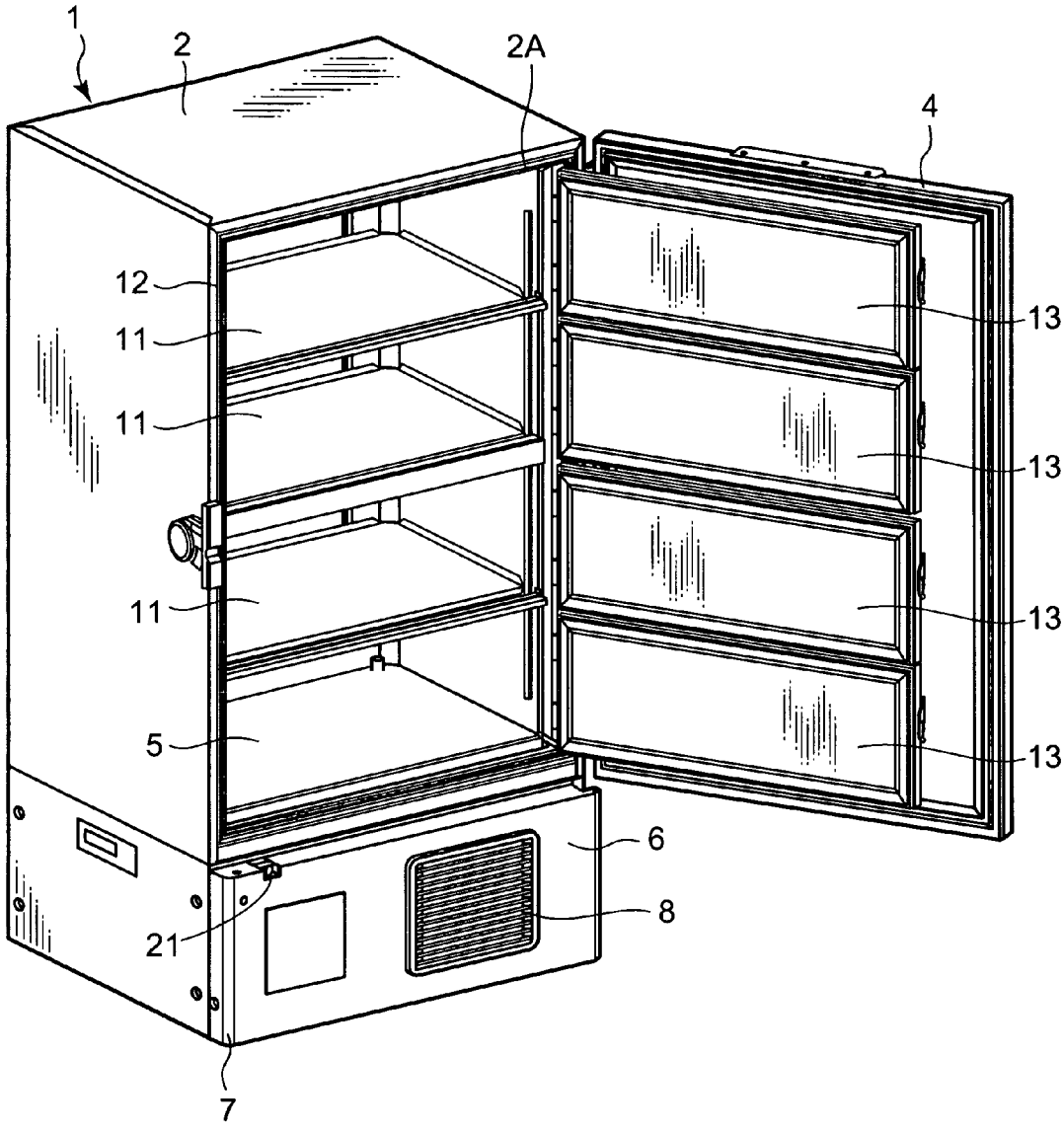
FIG. 2 is a perspective view of a state in which an outer door (thermal insulating door) and an inner door of the low-temperature storage of the present invention are opened.

Embodiments of the present invention will be described hereinafter in detail with reference to the drawings. As shown in FIGS. 1 and 2, a low-temperature storage (ultra low temperature freezer) of the present invention comprises: a thermal insulation box main body 2 having an opening 2A in a front surface; a right-opening type thermal insulating door 4 which is an outer door openably/closably attached to the thermal insulation box main body 2 via a plurality of (three in the present embodiment) hinges 3 to close the opening 2A; a storage chamber 5 formed by the door 4 and the main body 2; a cooling device (not shown) positioned under the storage chamber 5 to cool the storage chamber 5; and a mechanical chamber 6 in which an electrical/mechanical component such as an electrically equipped box 9 is stored. The front surface of the mechanical chamber 6 is openably/closably covered with a front panel 7, and a grille 8 which is a suction port cover with respect to an air guide duct disposed behind the panel, a filter for capturing dust, a condenser and the like (not shown) is attached to the front panel 7.

In FIG. 2, the storage chamber 5 is divided into a plurality of (four in the present embodiment) upper/lower sections by a plurality of (three in the present embodiment) shelves 11. Frontage portions 12 corresponding to these sections (hereinafter referred to as small storage chambers) are also openably closed by thermal insulating inner doors 13.

Figure 3:
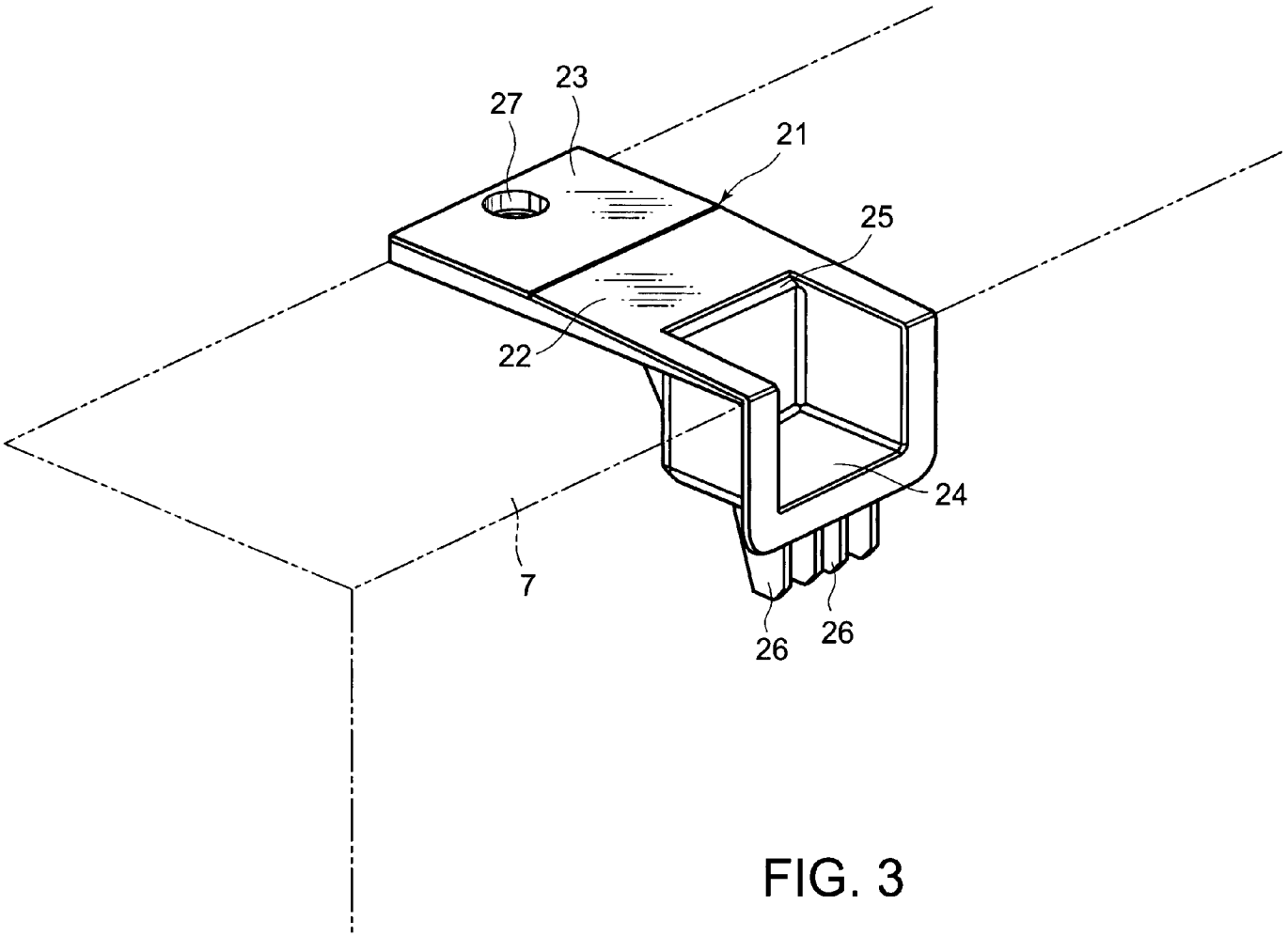
FIG. 3 is a perspective view showing a main-body-side spacer showing one example of the present invention.
Figure 4:
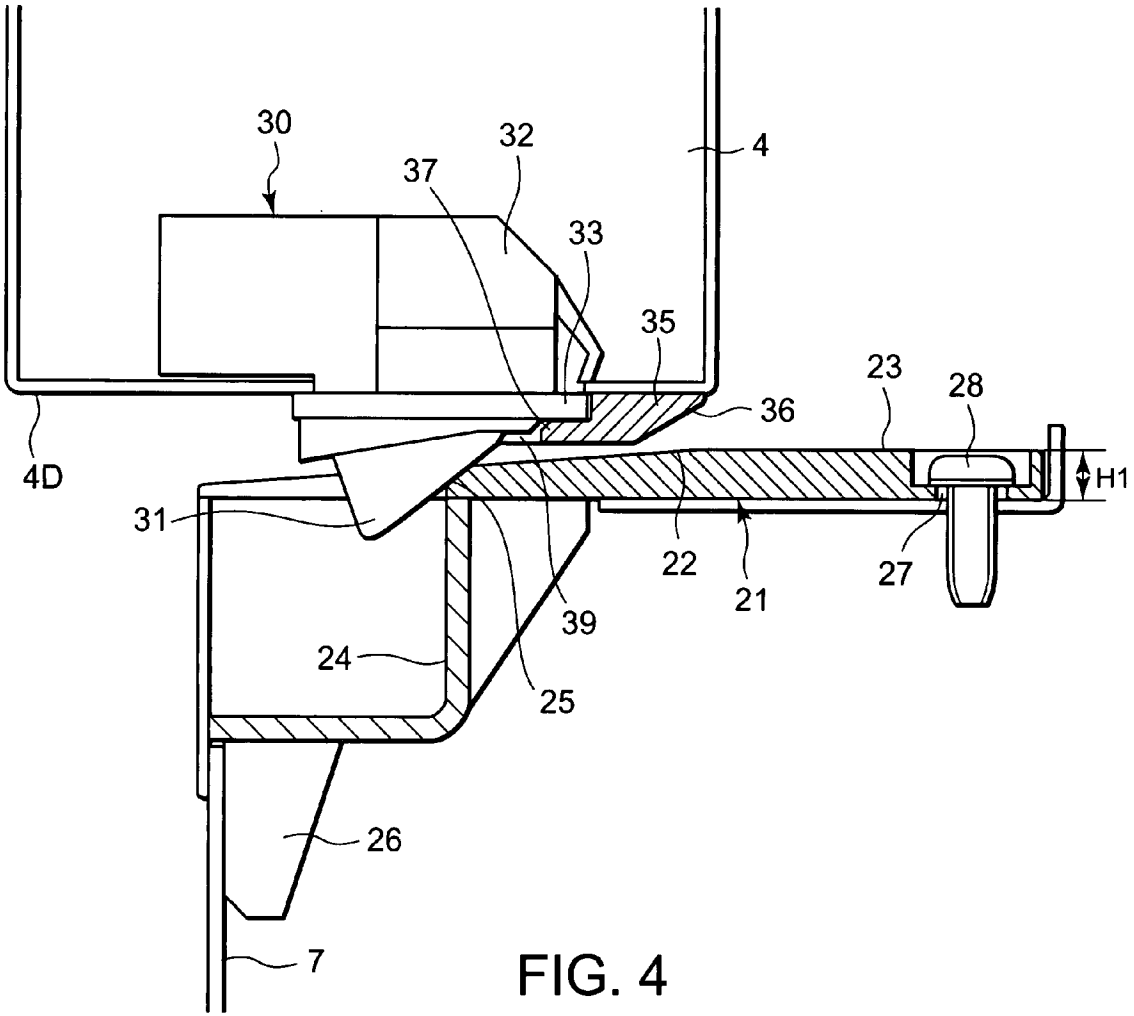
FIG. 4 is a main part sectional view showing an attached state of the main-body-side spacer of the present invention.

In FIGS. 2 to 4, reference numeral 21 denotes an opening edge of the thermal insulation box main body positioned on a side (i.e., non-shaft-support side) on which any of the hinges 3 for axially supporting the thermal insulating door 4 is not disposed, and especially denotes a main-body-side spacer disposed on the side of the main body of the low-temperature storage 1 and formed of a polyacetal or acetal resin in the present embodiment. The spacer has: a forward/downward tilting guide surface 22 which forcibly corrects door lowering by a closing operation of the thermal insulating door 4; a flat interval holding surface 23 which holds the lower surface of the thermal insulating door 4 at a necessary height H1; and a receiving portion 24 which receives a door switch 30 positioned on the side (non-shaft-support side) on which any of the hinges 3 is not disposed in the lower surface of the thermal insulating door 4.

The main-body-side spacer 21 has a fixing hole 27 for fixing to the front panel 7 in a rear part, that is, the interval holding surface 23, and supporting protrusions 26 supported by the front panel 7 on a front part. The receiving portion 24 comprises an abutment surface 25 having an inclination angle larger than that of the guide surface 22. The receiving portion 24 forms a concave portion for preventing a switch portion 31 of the door switch 30 from colliding with the front panel 7 at the time of a closing operation of the thermal insulating door 4. On the other hand, the receiving portion first abuts on the switch portion 31 by the abutment surface 25, absorbs shock, and assists vertical movement of the switch portion 31.

Figure 5:
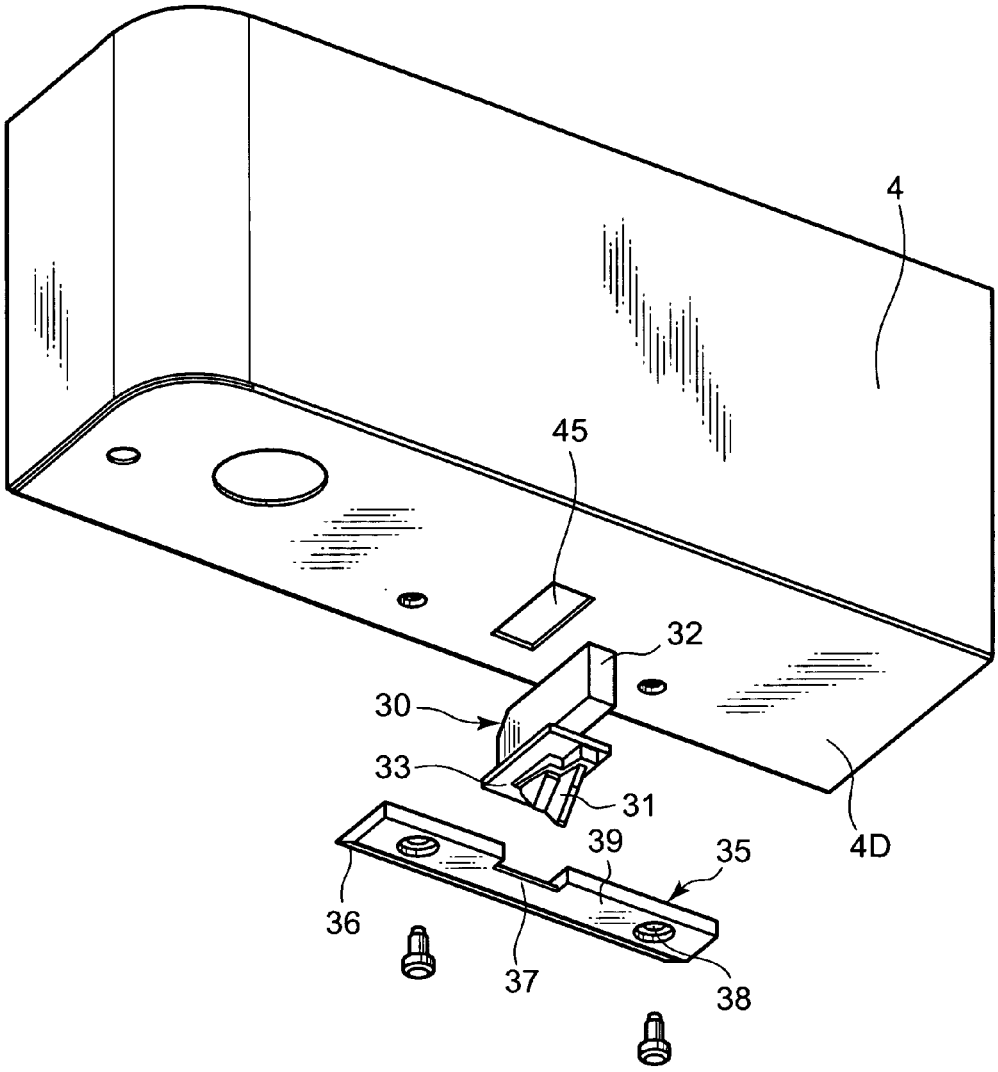
FIG. 5 is an exploded perspective view showing attaching of a door-side spacer and a door switch of the present invention.

In FIGS. 4 and 5, reference numeral 30 denotes a door switch positioned on the side (non-shaft-support side) on which any of the hinges 3 is disposed in a lower surface 4D of the thermal insulating door 4 to detect an opened/closed state of the thermal insulating door 4 (especially, closed door). The switch comprises: a switch main body 32 inserted into the door via an attaching hole 45 disposed in the lower surface 4D of the thermal insulating door; and an attaching piece 33 having the vertically movable switch portion 31 and protruding downwards from the door 4.

Reference numeral 35 denotes a door-side spacer disposed on the side (non-shaft-support side) on which any of the hinges 3 is not disposed in the lower surface 4D of the thermal insulating door and formed of a resin such as a polyacetal or acetal resin. The spacer comprises: a rearward rising/tilting auxiliary surface 36 which abuts on the guide surface 22 of the main-body-side spacer 21 by the closing operation of the thermal insulating door 4 to forcibly correct the door lowering with the closing operation; and a flat interval holding surface 39 which has a support portion 37 to be superimposed upon the attaching piece 33 of the door switch 30 from below to support the door switch 30, and fixing holes 38 and which holds the lower surface of the thermal insulating door 4 at a necessary height H2.

Embodiment 1

Figures 6A, 6B, 6C:
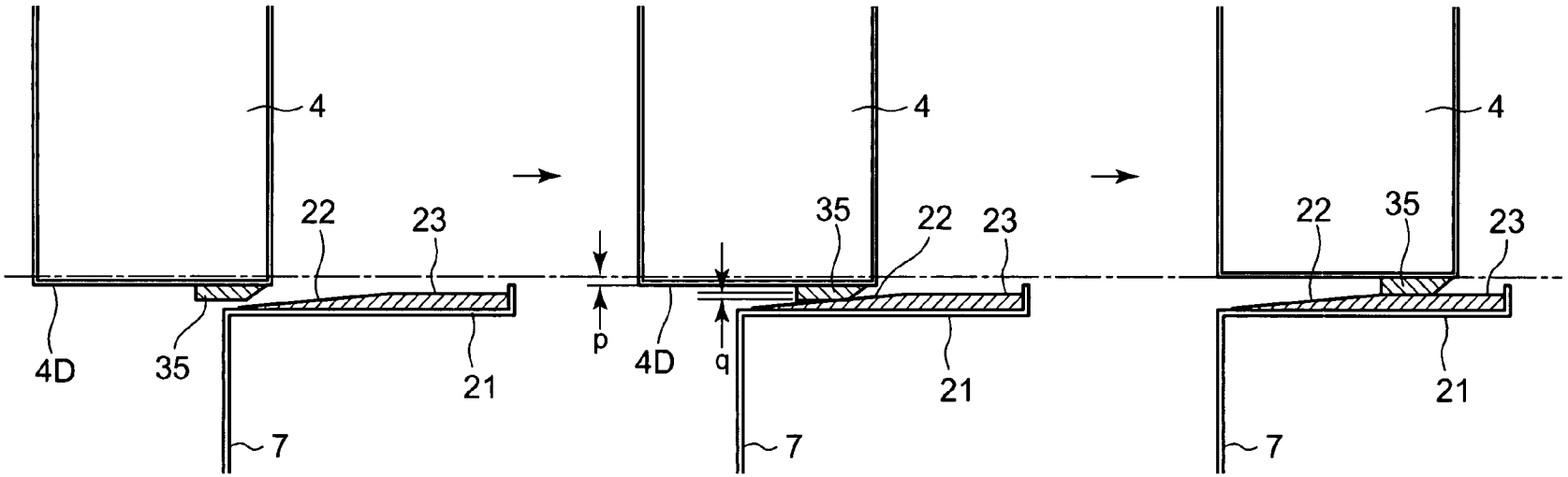
FIG. 6 is an operation explanatory view showing a situation in which door lowering is forcibly corrected by spacers (main-body-side spacer and door-side spacer) according to a first embodiment of the present invention.

An operation for correcting/modifying door lowering by a spacer in a first embodiment of the present invention will be described with reference to FIG. 6. FIG. 6 shows, in order from the left, (1) a non-abutting time when both spacers do not contact each other, (b) beginning of abutting, in which both the spacers contact each other, and (c) a closed time when a door is completely closed in a closing operation of the door. A height position of a door lower surface is corrected/modified by a distance corresponding to a height q from an abutment point of the guide surface 22 to the interval holding surface 23 shown in (b). It is to be noted that an interval p between a one-dot chain line and the door lower surface 4D is equal to the correction dimension q in (b).

In FIG. 6(*b*), in a closing operation for further pushing a thermal insulating door 4 rearwards after a door-side spacer 35 abuts on a guide surface 22 of a main-body-side spacer 21, the door-side spacer 35 is gradually pushed upwards along the guide surface 22. Therefore, the lower surface of the thermal insulating door is guided upwards along the guide surface 22, and a lowered dimension is corrected by the guide surface 22 of the main-body-side spacer 21 disposed on a side on which any hinge is not disposed every closing operation of the thermal insulating door 4. Therefore, a user can automatically and forcibly correct the door lowering of the thermal insulating door utilizing a closing force of the door at the time of a door opening/closing operation. Additionally, the main-body-side spacer 21 is positioned on the side on which any hinge is not disposed. Therefore, even when the door lowering by a slight dimension occurs because of a change with time, deterioration with year or the like, the door lowering can be correctly grasped, because the spacer is distant from the hinge. This can contribute to the correction of the lowered dimension of the door, and the door lowering accompanying the change with time or the deterioration with year can be prevented from being caused.

The lower surface of the thermal insulating door is guided upwards along the guide surface 22 and the lowered dimension is corrected every closing operation of the thermal insulating door 4 by the guide surface 22 of the resin-made main-body-side spacer 21 disposed on the opening edge of the thermal insulation box main body positioned on the side on which any of the hinges 3 is not disposed. Therefore, the user can automatically and forcibly correct the door lowering of the thermal insulating door utilizing the closing force of the door at the time of the door opening/closing operation. The receiving portion 24 of the main-body-side spacer 21 can receive the door switch 30 disposed on the lower surface of the thermal-insulating door 4 positioned on the side on which any of the hinges 3 is not disposed, and therefore the door switch 30 can be as disposed as closer to an end of the door on a non-shaft-support side as possible.

The spacer is constituted of the door-side spacer 35 disposed on the thermal insulating door 4, and the main-body-side spacer 21 disposed on the thermal insulation box main body (actually, a front panel 7). Therefore, even with the occurrence of the door lowering having a dimension which is smaller than that of a gap between the lower surface of the door and the opening peripheral edge of the thermal insulation box main body, the door lowering can be instantly corrected/modified. Moreover, since both the spacers are formed of a resin such as a polyacetal or acetal resin, the spacers can be structured to be strong against wear or change with time because of contacting/sliding between the spacers, and durability of the spacer is enhanced.

The attaching piece 33 of the door switch 30 is supported by the door-side spacer disposed on the lower surface of the thermal insulating door positioned on the side on which any of the hinges 3 is not disposed, therefore the door switch 30 can be more firmly fixed/supported by the door-side spacer 35, and a support member of the door switch 30 can be omitted.

The main-body-side spacer has a fixing hole 27 in the rear part, and a supporting protrusion 26 on the front part. Therefore, when the main-body-side spacer 21 is fixed to an attaching position, the supporting protrusion 26 is allowed to abut on the back surface of an outer box in a predetermined position, and is positioned, and a fixing member 28 such as a screw is fitted into the fixing hole 27 so that the spacer may be fixed. Attaching operation efficiency can be enhanced, and the number of components can be reduced. Since the receiving portion 24 of the main-body-side spacer 21 comprises the abutment surface 25 having an inclination angle larger than that of the guide surface 22, a switching operation of the door switch 30 can be performed with a smaller depth dimension.

Vertical movement of the switch portion 31 of the door switch 30 accompanying the opening/closing operation of the thermal insulating door 4 will be described with reference to FIG. 7. It is to be noted that, assuming a gap between an upper surface of the front panel 7 and the lower surface 4D of the thermal insulating door is H3, a relation between a height H1 of the main-body-side spacer 21 and a height H2 of the door-side spacer 35 is as follows:

$$H1+H2 \leqq H3.$$

Figure 7:
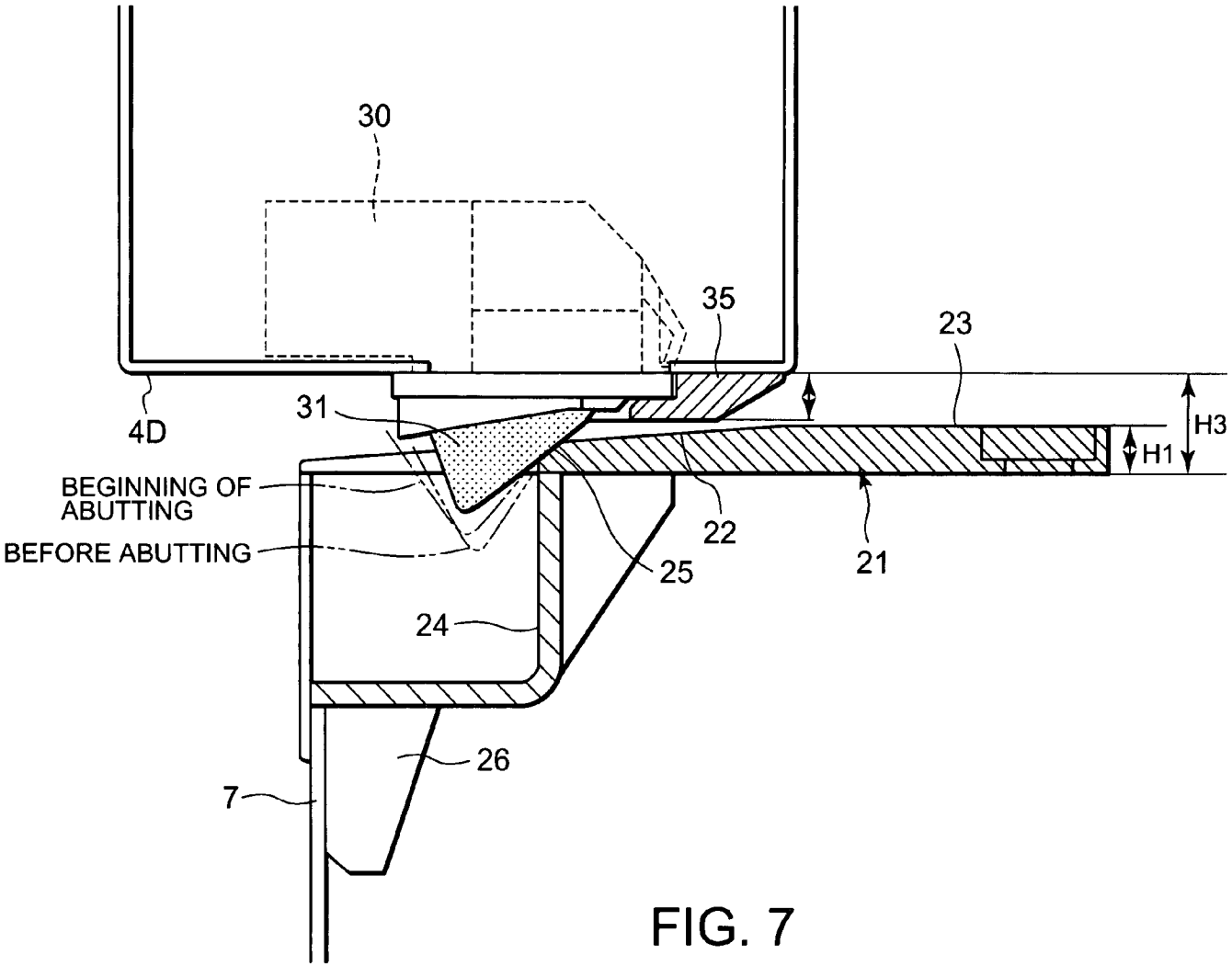
FIG. 7 is a main part sectional view showing a operation situation of the door switch of the present invention.

While the rear surface of the switch portion 31 does not contact the abutment surface 25 of the receiving portion 24, as shown by a two-dot chain line in FIG. 7., the switch portion 31 is lowered in its lowermost state by its own weight. When the thermal insulating door 4 is closed further from this position, and then the switch portion 31 contacts the abutment surface 25, as shown by a one-dot chain line of FIG. 7, the switch portion 31 slightly rises. Next, (although any user does not notice) the thermal insulating door 4 is further attached keeping the abutment on the abutment surface 25, the switch portion 31 gradually rises along the abutment surface 25, and a lower end (vertex portion) of the switch portion rides over the surface 25, and is laid on the guide surface 22. When the switch portion 31 is set in such a manner as to perform a switching operation in this state, it is judged that the door is closed. Therefore, the setting may be performed in such a manner as to perform the switching operation at a time when the lower end (vertex portion) reaches the interval holding surface 23.

Embodiment 2

A spacer in a second embodiment of the present invention will be briefly described with reference to FIG. 8. Reference numeral 40 denotes a door-side spacer disposed on a side (non-shaft-support side) on which any of hinges 3 is not disposed in a lower surface 4D of a thermal insulating door 4, and formed of a resin. The spacer has a flat interval holding surface 41 which holds the lower surface of the thermal insulating door 4 at a necessary height h1, and a rearward rising/tilting guide surface 42 which forcibly corrects door lowering by a closing operation of the thermal insulating door 4.

An operation for correcting/modifying the door lowering by the spacer in the second embodiment of the present invention will be described with reference to FIG. 8. In the same manner as in FIG. 6, FIG. 8 shows, in order from the left, (a) a non-abutting time when the spacer does not contact a front panel 7, (b) an abutting beginning time when the spacer contacts the front panel, and (c) a closed time when the door is completely closed in the closing operation of the door. A height position of the door lower surface 4D is corrected/modified by a distance corresponding to a height s from an abutment point of the guide surface 42 of the door-side spacer 40 to the interval holding surface 41 shown in (b). It is to be noted that a maximum height that can be corrected/modified in the door-side spacer 40 is h1. That is, the following relation is established:

$$s \leqq h1.$$

Moreover, a relation between a dimension H3 described in the first embodiment and h1 is as follows:

$$h1 \leqq H3.$$

Figures 8A, 8B, 8C:
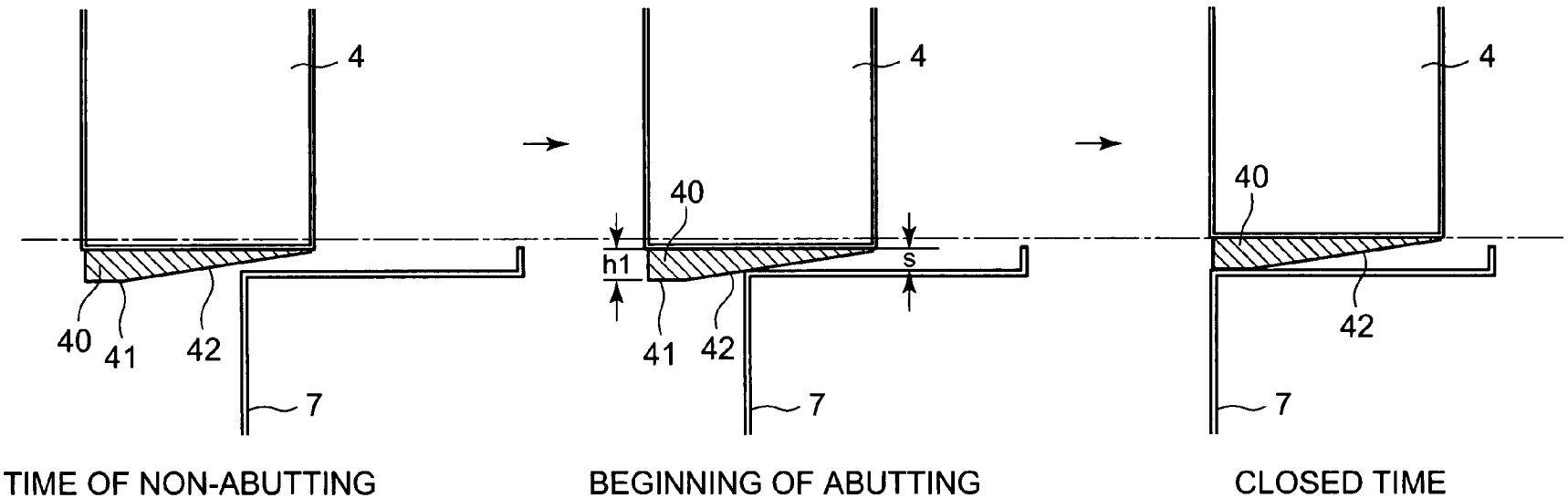
FIG. 8 is an operation explanatory view showing a situation in which the door lowering is forcibly corrected by the spacer (door-side spacer) according to a second embodiment of the present invention.

According to the spacer in the second embodiment of the present invention, in FIG. 8(*b*), in a closing operation for further pushing the thermal insulating door 4 rearwards after a rear end of the guide surface 42 of the door-side spacer 40 abuts on the front panel 7, the door-side spacer 40 is gradually pushed upwards along forward lowering tilt of the guide surface 42. That is, the lower surface of the thermal insulating door is guided upwards along the guide surface 42, and a lowered dimension is corrected by the guide surface 42 of the door-side spacer 40 disposed on a side on which any hinge is not disposed every closing operation of the thermal insulating door 4. Therefore, a user can automatically and forcibly correct the door lowering of the thermal insulating door utilizing a closing force of the door at the time of a door opening/ closing operation. Additionally, the door-side spacer 40 is positioned on the side on which any hinge is not disposed. Therefore, even when the door lowering by a slight dimension occurs because of a change with time, deterioration with year or the like, the door lowering can be correctly grasped, because the spacer is distant from the hinge. This can contribute to the correction of the lowered dimension of the door, and the door lowering accompanying the change with time or the deterioration with year can be prevented from being caused.

Embodiment 3

A spacer in a third embodiment of the present invention will be described with reference to FIG. 9. Reference numeral 50 denotes an opening edge of a thermal insulation box main body positioned on a side (non-shaft-support side) on which any of hinges 3 for axially supporting a thermal insulating door 4 is not disposed, and especially denotes a resin-made main-body-side spacer disposed on a main body side (upper part of a front panel 7) of a low-temperature storage 1 in the present embodiment. The spacer has a flat interval holding surface 51 which holds the lower surface of the thermal insulating door 4 at a necessary height h3, and a forward lowering/tilting guide surface 52 which forcibly corrects door lowering by a closing operation of the thermal insulating door 4.

An operation for correcting/modifying the door lowering by the spacer in the third embodiment of the present invention will be described with reference to FIG. 9. In the same manner as in FIG. 6, FIG. 9 shows, in order from the left, (a) a non-abutting time when a rear end of a lower surface 4D of the door does not contact the main-body-side spacer, (b) an abutting beginning time when the lower surface of the door contacts the main-body-side spacer, and (c) a closed time when the door is completely closed in the closing operation of the door. A height position of the door lower surface 4D is corrected/modified by a distance corresponding to a height t from an abutment point of the guide surface 52 to the interval holding surface 51 shown in (b). It is to be noted that a maximum height that can be corrected/modified in the main-body-side spacer 50 is h3. That is, the following relation is established:

$$t \leqq h3.$$

Moreover, a relation between a dimension H3 described in the first embodiment and h3 is as follows:

$$h3 \leqq H3.$$

Figures 9A, 9B, 9C:
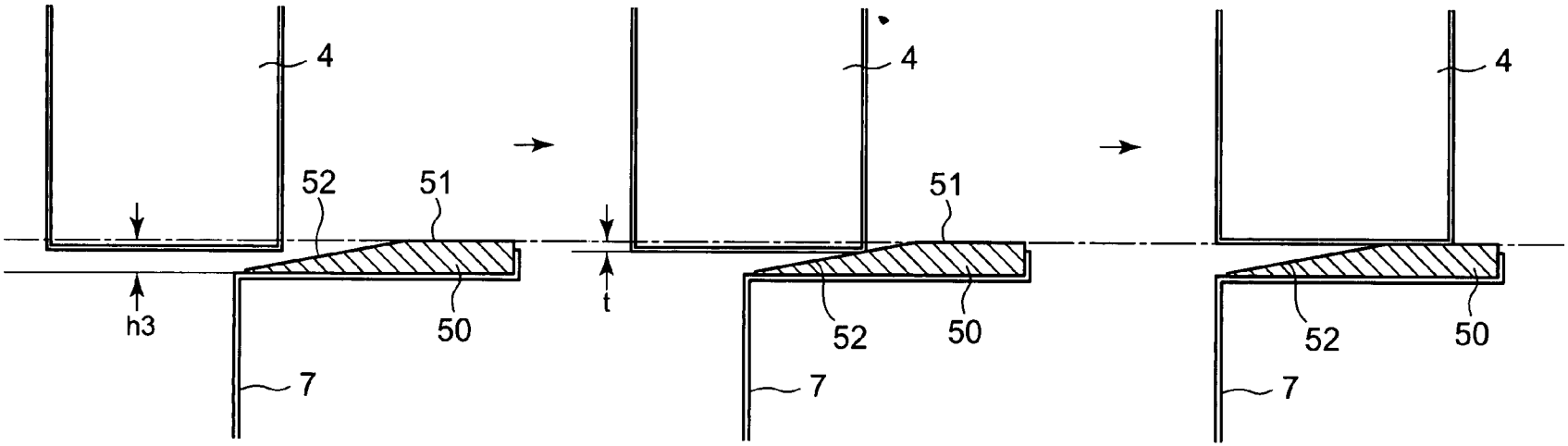
FIG. 9 is an operation explanatory view showing a situation in which the door lowering is forcibly corrected by the spacer (main-body-side spacer) according to a third embodiment of the present invention.

In FIG. 9(*b*), in a closing operation for further pushing the thermal insulating door 4 rearwards after a rear end of the lower surface 4D of the door abuts on the guide surface 52 of the main-body-side spacer 50, the rear end of the lower surface 4D of the door is gradually pushed upwards along the guide surface 52 of the main-body-side spacer 50. That is, the lower surface of the thermal insulating door is guided upwards along the guide surface 52, and a lowered dimension is corrected by the guide surface 52 of the main-body-side spacer 50 disposed on a side on which any hinge is not disposed every closing operation of the thermal insulating door 4. Therefore, a user can automatically and forcibly correct the door lowering of the thermal insulating door utilizing a closing force of the door at the time of a door opening/closing operation. Additionally, the main-body-side spacer 50 is positioned on the side on which any hinge is not disposed. Therefore, even when the door lowering by a slight dimension occurs because of a change with time, deterioration with year or the like, the door lowering can be correctly grasped, because the spacer is distant from the hinge. This can contribute to the correction of the lowered dimension of the door, and the door lowering accompanying the change with time or the deterioration with year can be prevented from being caused.

According to the spacer in the third embodiment of the present invention, since the spacer 50 is disposed on the thermal insulation box main body (actually, the upper part of the front panel 7), the lower surface 4D of the thermal insulating door is guided upwards along the guide surface 52, and the lowered dimension can be corrected every closing operation of the thermal insulating door 4. Additionally, the spacer is capable of functioning a discharge passage of dew condensation water generated in the opening peripheral edge of the thermal insulation box main body.

What is claimed is:

1. A low-temperature storage comprising:

a thermal insulation box main body having an opening in a front surface thereof;

a thermal insulating door openably/closably attached to the thermal insulation box main body by a plurality of hinges to close the opening; and a cooling device which cools a storage chamber formed by the door and the main body, wherein a spacer having a raised guide surface to forcibly correct door lowering by a closing operation of the thermal insulating door is disposed on a side on which any hinge is not disposed, wherein the spacer is constituted of a door-side spacer disposed facing downward on a bottom surface on the thermal insulating door, and a main-body-side spacer disposed on the thermal insulation box main body facing upward, and is formed of a DURACON® resin, said main-body-side spacer having a tilting guide surface and a flat interval holding surface for holding the bottom surface of the insulating door at a predetermined height.

2. A low-temperature storage comprising:

a thermal insulation box main body having an opening in a front surface thereof;

a thermal insulating door openably/closably attached to the thermal insulation box main body by a plurality of hinges to close the opening;

a cooling device which cools a storage chamber formed by the door and the main body; and a main-body-side spacer having:

a raised guide surface facing upward to forcibly correct door lowering by a closing operation of the thermal insulating door; and a receiving portion to receive a door switch disposed on a bottom surface of the thermal insulating door positioned on a side on which any hinge is not disposed, and formed of a resin is disposed on an opening edge of the thermal insulation box main body positioned on the side on which any hinge is not disposed.

3. The low-temperature storage according to claim 2, wherein the door switch is supported by a door-side spacer disposed on the lower surface of the thermal insulating door positioned on the side on which any hinge is not disposed.

4. The low-temperature storage according to claim 2, wherein the main-body-side spacer has a fixing hole in a rear part thereof, and a supporting protrusion on a front part thereof.

5. The low-temperature storage according to claim 2, wherein the receiving portion has a tilt angle receiving portion comprising an abutment surface having a tilt angle larger than the tilt angle of the raised guide surface.

6. A low-temperature storage comprising:

a thermal insulation box main body having an opening in a front surface thereof;

a thermal insulating door openably/closably attached to the thermal insulation box main body by a plurality of hinges to close the opening; and a cooling device which cools a storage chamber formed by the door and the main body, the storage further comprising:

a main-body-side spacer having a raised guide surface, disposed facing upward on an opening edge of the thermal insulation box main body positioned on a side on which any hinge is not disposed, to forcibly correct door lowering by a closing operation of the thermal insulating door, and a receiving portion to receive a door switch disposed on a bottom surface of the thermal insulating door positioned on the side on which any hinge is not disposed; and a door-side spacer, disposed facing downward on the bottom surface of the thermal insulating door positioned on the side on which any hinge is not disposed, to abut on the raised guide surface by a closing operation of the thermal insulating door so that door lowering is forcibly corrected.

* * * * *